US006220688B1

(12) United States Patent
Ishimatsu et al.

(10) Patent No.: US 6,220,688 B1
(45) Date of Patent: Apr. 24, 2001

(54) LIQUID JET RECORDING HEAD AND A METHOD FOR MANUFACTURING LIQUID JET RECORDING HEADS

(75) Inventors: Shin Ishimatsu; Haruhiko Terai, both of Yokohama; Masafumi Takimoto, Tokyo; Akira Goto, Yokohama; Junji Tatsumi; Hiroshi Koshikawa, both of Kawasaki; Toshinori Hasegawa, Yokohama; Ken Ikegame, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/949,704

(22) Filed: Oct. 14, 1997

(30) Foreign Application Priority Data

| | | |
|---|---|---|
| Oct. 14, 1996 | (JP) | 8-291052 |
| Dec. 5, 1996 | (JP) | 8-340628 |
| Oct. 9, 1997 | (JP) | 9-293530 |

(51) Int. Cl.[7] ..... B41J 2/015
(52) U.S. Cl. ..... 347/20; 347/45
(58) Field of Search ..... 347/45, 47, 63; 156/153, 272.6, 272.8

(56) References Cited

U.S. PATENT DOCUMENTS

| | | | |
|---|---|---|---|
| 5,148,192 | 9/1992 | Izumida et al. . | |
| 5,208,604 | 5/1993 | Watanabe et al. . | |
| 5,361,087 | 11/1994 | Tajima et al. . | |
| 5,365,255 | 11/1994 | Inoue et al. . | |
| 5,371,528 | 12/1994 | Izumida et al. . | |
| 5,594,479 | 1/1997 | Inoue et al. . | |
| 5,657,539 | 8/1997 | Orikasa et al. . | |
| 5,855,713 * | 1/1999 | Harvey | 156/153 |
| 5,874,031 * | 2/1999 | Okuda et al. | 264/50 |

FOREIGN PATENT DOCUMENTS

| | | |
|---|---|---|
| 0 561 482 | 9/1993 | (EP) . |
| 0 656 261 | 6/1995 | (EP) . |
| 0 719 643 | 7/1996 | (EP) . |
| 55-132253 | 10/1970 | (JP) . |
| 2-187351 | 7/1990 | (JP) . |
| 3-101958 | 4/1991 | (JP) . |
| 5-330067 | 12/1993 | (JP) . |
| 8-11306 | 1/1996 | (JP) . |
| 8-058097 | 3/1996 | (JP) . |

OTHER PUBLICATIONS

Hawley's Condensed Chemical Dictionary, 13th Edition, pp. 906–907, 1997.*

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A liquid jet recording head comprises a first substrate having a plurality of discharge energy generating devices formed thereon, and a second substrate having a discharge opening plate provided with a plurality of discharge openings for discharging ink, and recessed portions becoming ink flow paths conductively connected with said discharge openings, and a common liquid chamber for retaining ink to be supplied to each of said discharge openings, respectively. The ink flow paths and common liquid chamber are formed by joining the first substrate and second substrate with the discharge energy generating devices of the first substrate facing the recessed portions becoming ink flow paths of the second substrate, at the same time, the joint between the first substrate and second substrate being sealed by sealing compound, and fine grains inclusively residing on the joint between the first substrate and second substrate. With the liquid jet recording head thus structured, there is no possibility that sealing compound flows into the ink flow paths and discharge openings even if the joint between the first and second substrates are sealed by sealing compound, and that any defective prints take place. The production yield in the sealing step of manufacture is increased, at the same time, the controlling burden is lightened.

29 Claims, 6 Drawing Sheets

LIQUID JET RECORDING HEAD AND A METHOD FOR MANUFACTURING LIQUID JET RECORDING HEADS

BACKGROUND OF THE INVENTION

1. Field of the Invention

The present invention relates to a liquid jet recording head that discharges recording liquid from the discharge openings as flying droplets to cause them to adhere to a recording medium for printing. The invention also relates to a method for manufacturing such liquid jet recording heads.

2. Related Background Art

The conventional liquid jet recording head is structured in such a manner that as shown in FIGS. 8A and 8B, a first substrate 100, having discharge energy generating devices formed on the silicon substrate, is joined to a second substrate 101, having the recessed portions that form ink flow paths 102; a discharge opening plate 104 provided with discharge openings 103 conductively connected with the ink flow paths 102 to discharge ink; and a recessed portion that constitutes a common liquid chamber 105 that temporarily retains ink to be supplied to each of the ink flow paths 102, and that the joint between the first substrate 100 and the second substrate 101 is sealed by the application of a sealing compound (see Japanese Patent Application Laid-Open No. 55-132253).

Further, a liquid jet recording head for use of color recording is structured in such a manner that as shown in FIG. 10, a first substrate having discharge energy generating devices formed on it is joined to a ceiling plate (a second substrate) 111 having ink discharge nozzles, which is provided with a plurality of liquid chambers 115 each partitioned to receive the supply of ink of different colors, respectively, and that grooves 119 are formed on the second substrate 111 to separate each of the liquid chambers for its reliable partition and division. The partition grooves 118 are filled with a sealing compound.

However, the conventional liquid jet recording head such as shown in FIGS. 8A and 8B tends to allow the sealing compound to flow from the slight gap between the first substrate 100 and the second substrate 101 into the ink flow paths 102, as well as into the discharge opening unit 103, when the joint between the first substrate 100 and the second substrate 101 is sealed by the application of the sealing compound. The recording heads having the ink flow paths 102 or discharge opening unit 103, which are affected by the flow-in of the sealing compound, may cause defective discharges of ink. Therefore, the recording heads showing such defect are regarded as defective products. As a countermeasure to prevent the sealing compound from flowing into the ink flow paths and/or discharging openings, there is a structure disclosed in the specification of Japanese Patent Application Laid-Open No. 2-187351 whereby to provide sealing receptacles 108 on both s the ink flow paths as shown in FIG. 9 for receiving sealing compound. Nevertheless, even with the provision of such receptacles necessary to rigidly control the viscosity of the sealing compound, its tack-free characteristics, the amount of its application, and the like for use.

Further, the grooves 118 for filling the sealing compound used for partitioning each of the liquid chambers, which are arranged between each of the common liquid chambers formed on the second substrate of the conventional color liquid jet recording head (herein-after referred to simply as common liquid chamber partition grooves), are arranged continuously up to the nozzle unit for discharging ink from each of the liquid chambers. When the sealing compound is filled in the common liquid chamber partition grooves 118 for separating colors, there is a need for enabling the flow of the sealing compound to be suspended in the common liquid chamber partition grooves or dummy nozzles so that the sealing compound is not allowed to flow into the nozzles used for discharging ink. However, since the sealing compound flows in the common liquid chamber partition grooves 118 and the dummy nozzles by means of capillary phenomenon, it is extremely difficult to control the filling amount thereof in good precision. In other words, if the filling amount of the sealing compound is too large, it overflows from the dummy nozzles to seal even the ink flow paths eventually. When the filling amount of the sealing compound is too small, the flow thereof is caused to be suspended in the mid way of the common liquid chamber separation grooves. As a result, it becomes impossible to separate the liquid chambers completely, leading to the occurrence of mixed colors. In either case, the production yield is lowered in the sealing step of the manufacture of heads inevitably.

As a countermeasure thereof, there is disclosed a devise regarding the configuration of the common liquid chamber separation walls in the specification of Japanese Patent Application Laid-Open No. 8-11306 (the application No. 6-146244). However, with the adoption of such means as disclosed in this application, it is still difficult to execute the sealing reliably.

SUMMARY OF THE INVENTION

In consideration of the problems yet to be solved for the conventional techniques as described above, the present invention is designed and aimed at providing a liquid jet recording head capable of being easily and reliably sealed so as to eliminate the reduction of the production yield at the sealing step in manufacturing it. The present invention is also aimed at providing a method for manufacturing such liquid jet recording heads.

In order to achieve the objectives described above, the liquid jet recording head of the present invention comprises a first substrate having a plurality of discharge energy generating devices formed thereon; and a second substrate having a discharge opening plate provided with a plurality of discharge openings for discharging ink, and recessed portions becoming ink flow paths conductively connected with the discharge openings, and a common liquid chamber for retaining ink to be supplied to each of the discharge openings, respectively. The ink flow paths and common liquid chamber are formed by joining the first substrate and second substrate with the discharge energy generating devices of the first substrate facing the recessed portions becoming ink flow paths of the second substrate, at the same time, the joint between the first substrate and second substrate being sealed by sealing compound, and fine grains inclusively reside on the joint between the first substrate and second substrate.

Then, the method for manufacturing liquid jet recording heads in accordance with the present invention comprises the steps of preparing a first substrate having a plurality of discharge energy generating devices formed thereon; preparing a second substrate having a discharge opening plate provided with a plurality of discharge openings for discharging ink, and recessed portions becoming ink flow paths conductively connected with the discharge openings, and a common liquid chamber for retaining ink to be supplied to each of the discharge openings, respectively; causing fine grains to adhere to the joint between the second substrate and first substrate; positioning the first substrate and second substrate so as to enable the discharge energy generating devices of the first substrate to face the recessed portions of the second substrate becoming ink flow paths, and forming the ink flow paths and common liquid chamber by joining the first substrate and second substrate; and sealing the joint between the first substrate and second substrate by sealing compound.

Further, in order to achieve the objectives described above, the liquid jet recording head of the present invention comprises a first substrate having a plurality of discharge energy generating devices formed thereon; and a second substrate having a discharge opening plate provided with a plurality of discharge openings for discharging ink, and recessed portions becoming ink flow paths conductively connected with the discharge openings, and a plurality of common liquid chambers for retaining ink to be supplied to each of the discharge openings, respectively. The ink flow paths and common liquid chambers are formed by joining the first substrate and second substrate with the discharge energy generating devices of the first substrate facing the recessed portions becoming ink flow paths of the second substrate, at the same time, a plurality of different ink being retained in the plurality of common liquid chambers. Between the plural common liquid chambers are sealed by sealing compound, and fine grains inclusively reside on the joint of the first substrate and second substrate between the plural common liquid chambers.

Further, the method for manufacturing liquid jet recording heads in accordance with the present invention comprises the steps of preparing a first substrate having a plurality of discharge energy generating devices formed thereon; preparing a second substrate having a discharge opening plate provided with a plurality of discharge openings for discharging ink, and recessed portions becoming ink flow paths conductively connected with the discharge openings, and a plurality of common liquid chambers for retaining ink to be supplied to each of the discharge openings, respectively; causing fine grains to adhere at least between the portions of the plurality of common liquid chambers of the joint of the second substrate to the first substrate; positioning the first substrate and second substrate so as to enable the discharge energy generating devices of the first substrate to face the recessed portions of the second substrate becoming ink flow paths, and forming the ink flow paths and common liquid chambers by joining the first substrate and second substrate; and sealing the joint between the first substrate and second substrate by sealing compound.

Also, for the achievment of the objectives hereof, the ink jet recording head further comprises common liquid chamber partition grooves between the plurality of common liquid chambers of the second substrate, in which the sealing between common liquid chambers is effectuated by injecting the sealing compound into the common liquid partition grooves.

Also, the fine grains inclusively reside on the joint between the discharge opening plate of the second substrate and the first substrate, and at the same time, the joint between the discharge opening plate and the first substrate is seal by sealing compound.

Also, the common liquid chamber partition grooves extend to the discharge opening plate portion through ink flow path portion, and dummy nozzles unused for discharging ink are provided for the ink flow path portions adjacent to the common liquid chamber partition grooves, respectively.

Further, the method for manufacturing liquid jet recording heads in accordance with the present invention comprises the steps of preparing a first substrate having a plurality of discharge energy generating devices formed thereon; preparing a second substrate having a discharge opening plate provided with a plurality of discharge openings for discharging ink, and recessed portions becoming ink flow paths conductively connected with the discharge openings, and a plurality of common liquid chambers for retaining ink to be supplied to each of the discharge openings, respectively; causing fine grains to adhere at least between the portions of the plurality of common liquid chambers of the joint of the second substrate to the first substrate; positioning the first substrate and second substrate so as to enable the discharge energy generating devices of the first substrate to face the recessed portions of the second substrate becoming ink flow paths, and forming the ink flow paths and common liquid chambers by joining the first substrate and second substrate; and sealing the joint between the first substrate and second substrate by sealing compound.

Also, the second substrate is provided with common liquid chamber partition grooves between the plurality of common liquid chambers, and the sealing between common liquid chambers is effectuated by injecting the sealing compound into the common liquid partition grooves.

Also, the adhesion of the fine grains is provided for the joint between the discharge opening plate of the second substrate and the first substrate, and at the same time, the joint between the discharge opening plate and the first substrate is sealed by sealing compound.

Also, the common liquid chamber partition grooves extend to the discharge opening plate portion through ink flow path portion, and dummy nozzles unused for discharging ink are provided for the ink flow path portions adjacent to the common liquid chamber partition grooves.

Also, for the liquid jet recording head and the method for manufacturing liquid jet heads in accordance with the present invention, it is preferable to adopt the material of the fine grains that contains as the main component thereof at least one element contained in the composition of the material of the second substrate. Further, it is preferable to form the fine grains by material having carbon as the main component thereof. Also, it is preferable to arrange that the surface of the fine grains is formed by polymeric material having hydroxyl group.

Furthermore, with respect to the liquid jet recording head and the method for manufacturing liquid jet recording heads in accordance with the present invention, it is preferable to provide the adhesion of fine grains by processing the second substrate by means of laser and/or heating.

With the structure of the liquid jet recording head described above, there is no possibility that sealing compound flows into the ink flow paths and discharge openings even if the joint between the first and second substrates and its circumference are sealed by the application of sealing compound, and that any defective prints may take place. As a result, it is possible to increase the production yield in the sealing step of manufacture, as well as to lighten the controlling burden in the sealing step thereof.

Also, in accordance with the method for manufacturing liquid jet recording heads structured as described above, there is no possibility that any sealing contamination may take place such as sealing compound flowing into the ink flow paths and discharge openings. It is also possible to enhance the production yield in the sealing step of manufacture, and to manufacture liquid jet recording heads capable of providing good printing quality.

Then, with respect to fine grains, it may be possible to utilize laser by-products obtainable by processing the second substrate by means of laser and/or heating.

Moreover, the present invention is structured to make it easier to control sealing compound in the sealing step of manufacture and color separation step thereof both for the color liquid jet recording head and the method of manufacture thereof. Therefore, color liquid jet recording heads can be manufacture easily in good production yield.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore, reference is made to the claims which follow the description for determining the scope of the invention.

BRIEF DESCRIPTION OF THE DRAWINGS

FIG. 8A is a perspective view which shows the second substrate thereof; and

FIG. 8B is a perspective view which shows such liquid jet recording head.

DETAILED DESCRIPTION OF THE PREFERRED EMBODIMENTS

Hereinafter, with reference to the accompanying drawings, the description will be made of the embodiments in accordance with the present invention.

Figure 1:
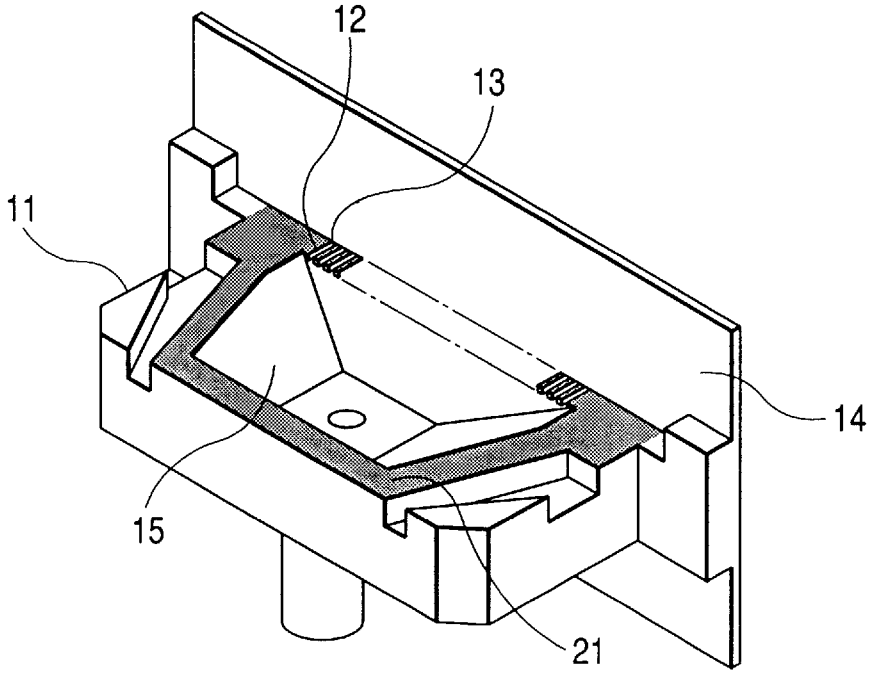
FIG. 1 is a perspective view which shows a second substrate that constitutes a liquid jet recording head in accordance with a first embodiment of the present invention.
Figure 2:
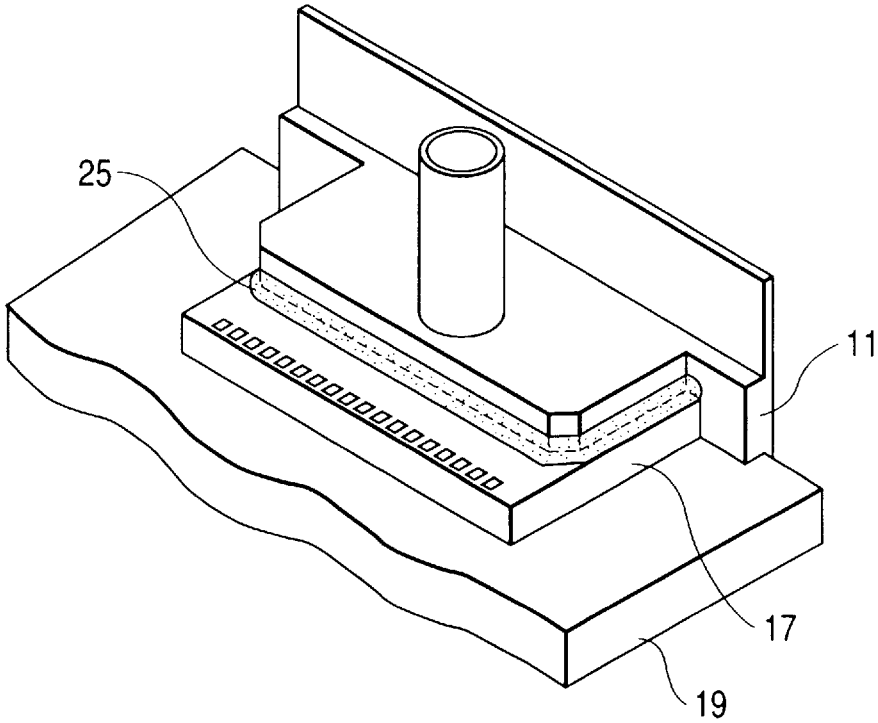
FIG. 2 is a perspective view which shows the liquid jet recording head in accordance with the first embodiment of the present invention.
Figure 3:
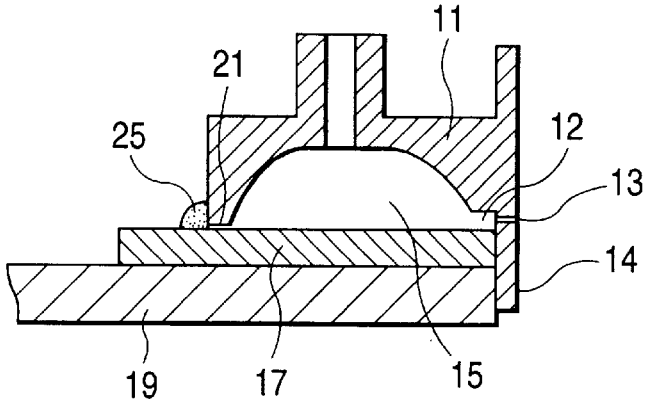
FIG. 3 is a vertically sectional view which shows the liquid jet recording head represented in FIG. 2.

FIG. 1 to FIG. 3 illustrate a first embodiment of the present invention. FIG. 1 is a perspective view showing the second substrate that constitutes a liquid jet recording head of the present invention. FIG. 2 is a perspective view showing a liquid jet recording head which is assembled by joining a first substrate and a second substrate. FIG. 3 is a cross-sectional view showing the liquid jet recording head represented in FIG. 2. The liquid jet recording head of the present invention comprises a second substrate 11, which is provided with a plurality of ink flow paths 12 to discharge ink; a plurality of discharge openings 13 conductively connected with the ink flow paths 12 to discharge ink, respectively; a discharge opening plate 14 having discharge openings formed therefor; and a common liquid chamber 15 that temporarily retains ink to be supplied to each of the ink flow paths 12, and a first substrate 17 having a plurality of discharge energy generating devices formed on it. The liquid jet recording head is assembled by joining the first substrate and the second substrate by a pressing force of an elastic member (not shown), while positioning the discharge energy generating devices on the first substrate 17 with respect to the ink flow paths and discharge openings 13 of the second substrate 11.

Then, before the second substrate 11 and the first substrate 17 are joined, it is arranged in accordance with the present invention that fine grains 21 adhere to the surface of the second substrate 11 to be joined with the first substrate 17. With the adhesion of the fine grains 21 to the joining surface, it is possible to suppress the flow of the sealing compound on the joining surface.

As the fine grains that adhere to the joining surface of the second substrate to the first substrate, it is possible to use a material whose main component is at least one of the elements contained in the composition of the material of the second substrate. If the second substrate is formed by resin, for example, the material to be used as the main component of fine grains should preferably contain carbon which is contained in the second substrate. It is also possible to use a polymeric material having hydroxyl group on the surface thereof. As other materials, it may be possible to use quartz filler, plastic filler, fine inorganic grains, fine inorganic oxide grains, or the like. Then, as means for effectuating the fine particle adhesion, laser processing and/or heating of the second substrate is adoptable. Particularly for the second substrate formed by polysulfonic resin material, it is possible to apply the irradiation of excimer laser beams to the processing surface so that a material whose main component is carbon may adhere to such surface of the second substrate. Here, the YAG laser, TEA-$CO_2$ laser, or the like, which makes abrasion processing possible, can also be selected for use.

Further, since there is a fear that non-discharge of ink may take place if the fine grains described above are allowed to enter and reside in the ink flow paths and the common liquid chamber, it is desirable to avoid any adhesion of such grains to the portions other than the joining surface of the first and second substrates. Here, by arranging to enable the fine grains to adhere to such surface on the second substrate side, it becomes possible to control the location of the fine grain adhesion irrespective of the errors that may take place on the joint between the first and second substrates. Also, when the structure is such that the material whose main component is carbon is arranged to adhere to the joining surface by the irradiation of excimer laser beams onto the second substrate which is formed by the polysulfonic resin as described earlier, it is possible to remove fine grains that adhere to the portions other than the joining surface by irradiating YAG laser selectively to such portions through a mask or the like. In this respect, since polysulfone does not absorb the energy of the YAG laser beams, there is no possibility that the second substrate is damaged.

As the sealing compound to be used for the present invention, it is preferable to use a sealing compound of a monoliquid hygroscopic hardening type. The preferable sealing compound of the hygroscopic go hardening type is such as to be hardened when absorbing moisture in the air, and also, capable of being hardened in a state where the sealing compound is injected into a desired position by means of capillary force. For the present invention, it is of course possible to use other sealing compounds than such type.

In accordance with the first embodiment of the present invention, before the second substrate 11 formed by sulfonic resin is joined to the first substrate 17, excimer laser beams of 248 nm is irradiated onto the joining surface of the second substrate 11 for 10 pulses with the laser energy concentration 1 J/cm$^2$·pulse, thus enabling fine grains 21 whose main component is carbon to adhere to the surface of the second substrate 11. Then, the second substrate 11 having the adhesion of fine grains 21 is joined to the first substrate 11 as shown in FIG. 2. The sealing portion 25 is sealed by the application of silicone resin of hygroscopic hardening type, TSE399 manufactured by Toshiba Silicone K.K. with the viscosity of 2800 to 3100 cp.

The condition of print by use of the liquid jet recording head whose first substrate 17 and second substrate 11 are joined and sealed through a third material 21 is compared with the condition of print by use of the liquid jet recording head sealed without any third material. The result of the comparison is that whereas approximately 40% of those sealed without any third material have presented defective prints at both ends of the ink flow paths 12, none of the liquid jet recording heads of the present invention have shown any defective prints.

Figure 9:
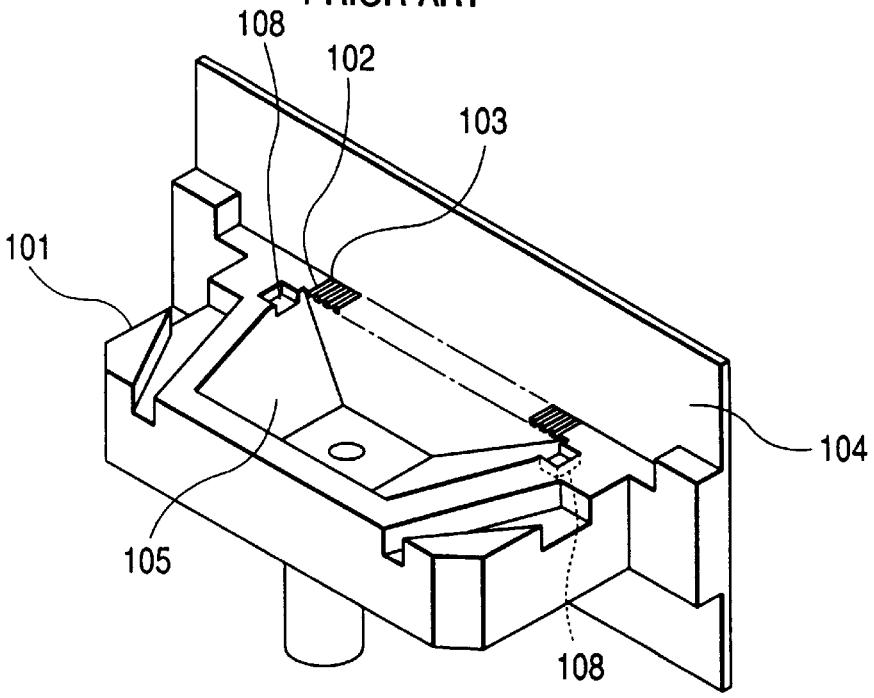
FIG. 9 PRIOR ART
FIG. 9 is a perspective view which shows the conventional second substrate provided with receptacles on both sides of the ink flow path array to receive sealing compound.
Figure 10:
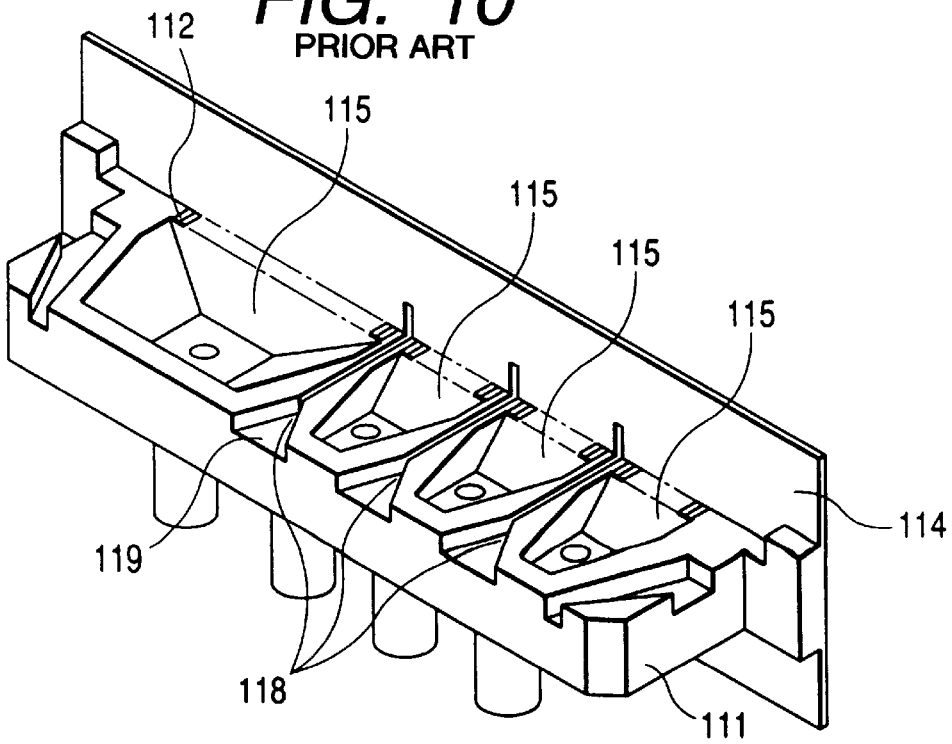
FIG. 10 PRIOR ART
FIG. 10 is a perspective view which shows the second substrate of the conventional liquid jet recording head for use of color recording.

Also, the condition of print by use of the liquid jet recording head sealed by means of a structure having receptacles 108 on both sides of the ink flow path array 108 to receive sealing compound as shown in FIG. 9 is compared with the condition of print by use of the liquid jet recording head sealed with the inclusion of fine grains in accordance with the present invention. The result of the comparison is that whereas approximately 20% of those sealed with the structure as shown in FIG. 9 have presented defective prints, none of those sealed with the inclusion of the third material 21 in accordance with the present invention as shown in FIG. 1 have shown any defective prints.

As described above, with the inclusion of fine grains on the joining surface of the second substrate, it is possible to prevent sealing compound from flowing into the ink flow paths and discharge openings because of the wettability of the surface in relation to the sealing compound even if the sealing compound is used for sealing the joint between the first and second substrates and the circumference thereof. In this way, the lowered production yield in the sealing step of manufacture can be eliminated.

Figure 4:
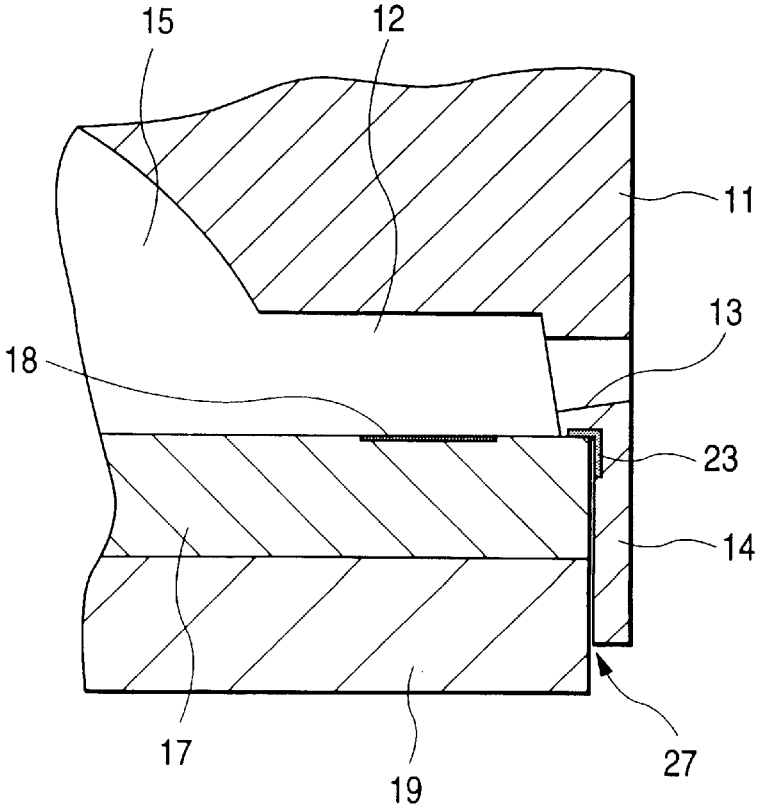
FIG. 4 is an enlarged sectional view which shows the principal part of the liquid jet recording head in accordance with a second embodiment of the present invention.

Now, with reference FIG. 4, the description will be made of a second embodiment in accordance with the present invention. FIG. 4 is an enlarged sectional view which shows the principal part of a liquid jet recording head, which is different from the first embodiment shown in FIG. 1 to FIG. 3 in that fine grains 23 are arranged to adhere to the boundary between the discharge opening plate 14 and the ink flow path array 12 of the second substrate 11, and that a gap 27 is formed between the first substrate 17 and the discharge opening plate 14 of the second substrate for the injection of sealing compound therebetween.

Before the second substrate 11 formed by polysulfonic resin is joined to the first substrate 17, the boundary between the discharge opening plate 14 and ink flow path array 12 of the second substrate 11 is irradiated by excimer laser beams of 248 nm for 10 pulses with the laser energy concentration of 1 J/cm$^2$·pulse to enable fine grains whose main component is carbon to adhere to the second substrate 11. Then, as shown in FIG. 4, the second substrate 11 having the adhesion of fine grains 23 is joined to the first substrate 11. To the gap 27, silicone resin of hygroscopic hardening type, TSE399 manufactured by Toshiba Silicone K.K. (viscosity 2400 cp), is injected to flow in as sealing compound to seal the joint.

As in the first embodiment, the comparison is made between the liquid jet recording head having the inclusion of fine grains 23 and the head having no grains. The result thereof is that whereas approximately 6% of those having no grains present the defective prints, none of those having the inclusion of fine grains 23 has shown any defective prints. In accordance with the conventional art, if the gap 27 is made larger, the sealing compound that seals the gap 27 flows around up to the surface of the discharge energy generating devices 18 so that discharges are made instable in some cases. However, in accordance with the embodiment shown in FIG. 4, it is possible to block the flow-in of the sealing compound from the gap 27 to the ink flow paths 12 by means of the adhesion of fine grains to the boundary between the discharge opening plate 14 and the ink flow paths 12 of the second substrate 11. As a result, there is no need for any rigid control of the gap 27. Also, it becomes possible to make the selection range of sealing compound wider.

Figure 5:
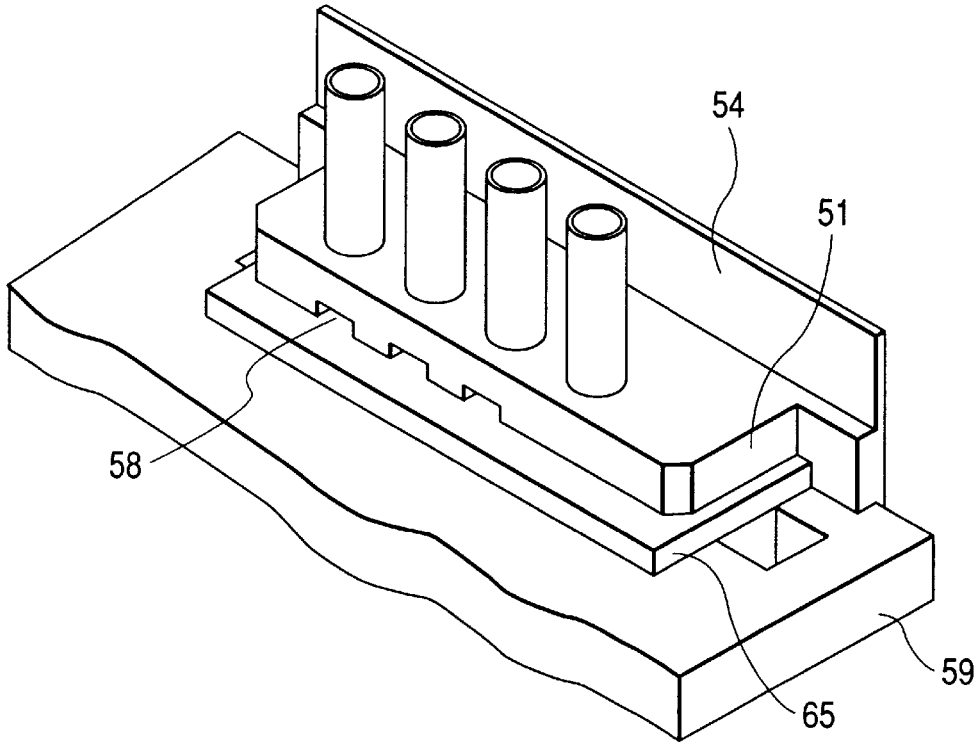
FIG. 5 is a perspective view which shows a color liquid jet recording head in accordance with a third embodiment of the present invention.
Figure 6:
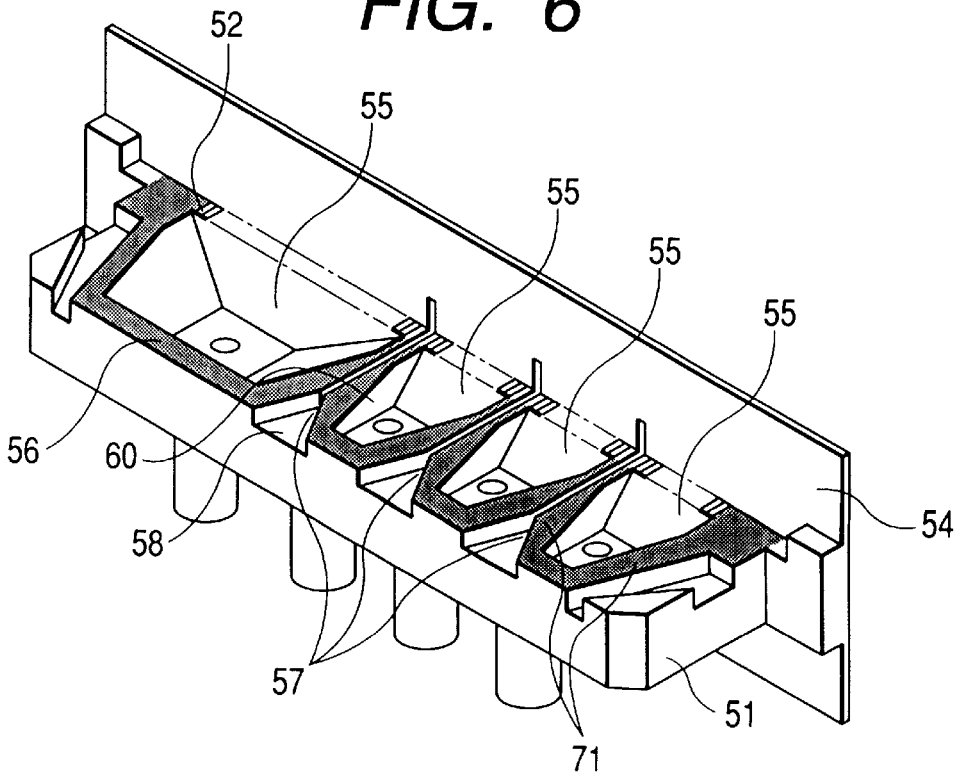
FIG. 6 is a perspective view which shows a second substrate of the color liquid jet recording head in accordance with the third embodiment of the present invention.
Figure 7:
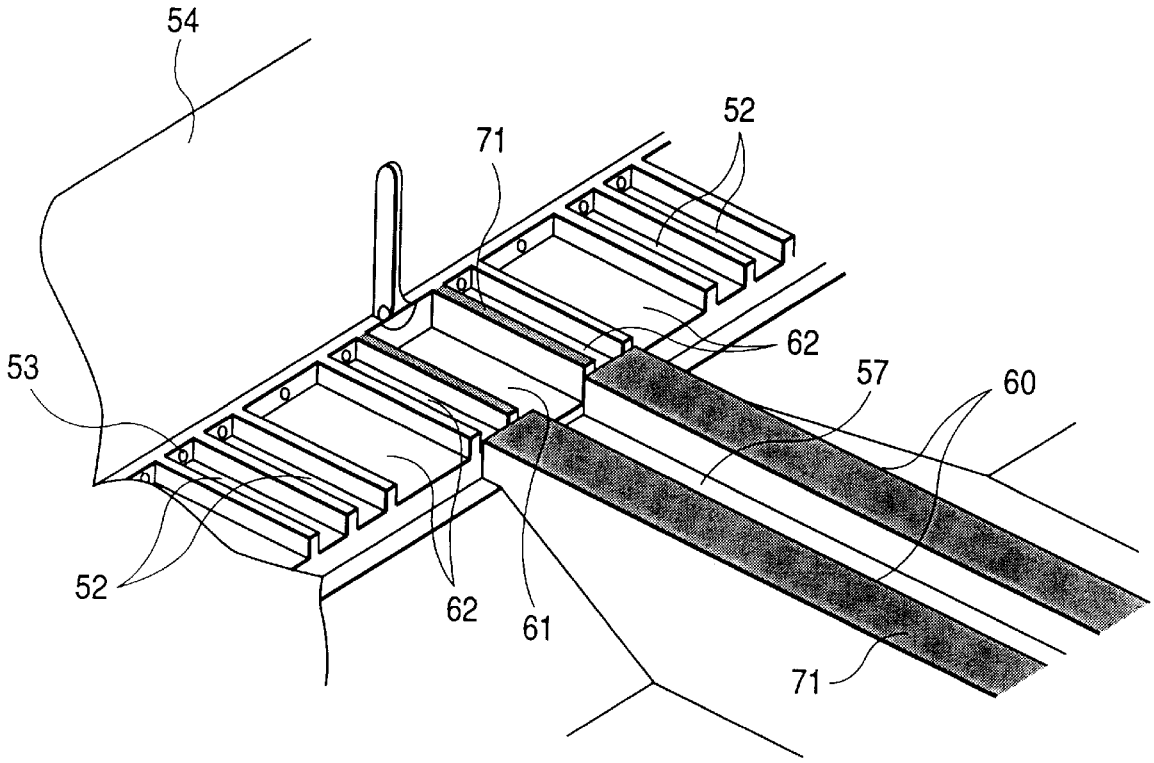
FIG. 7 is an enlarged view which shows the details of the principal part of the second substrate represented in FIG. 6.
Figure 8A:
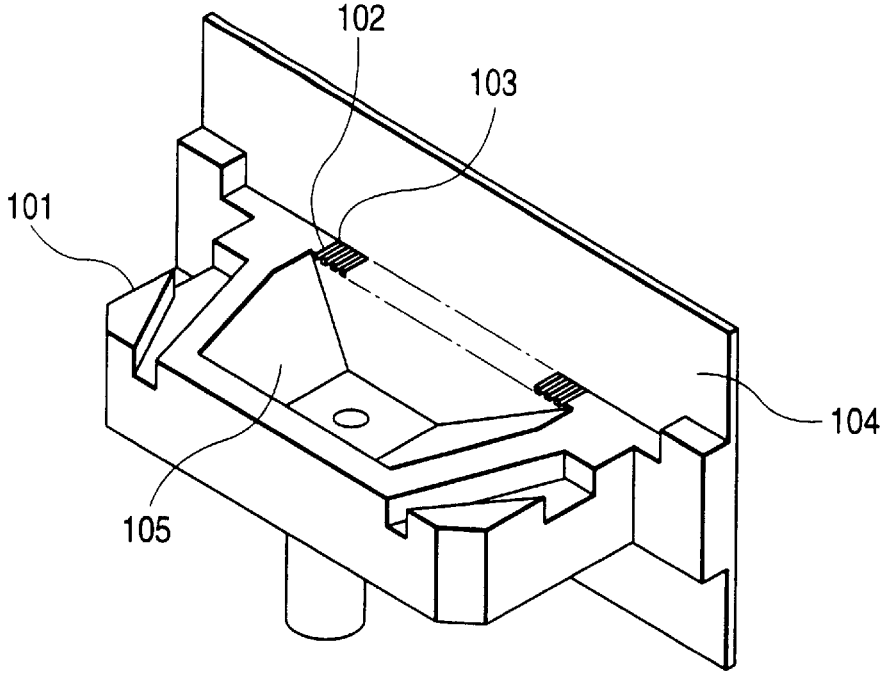
FIG. 8A PRIOR ART
FIGS. 8A and 8B are views which illustrate the conventional liquid jet recording head.
Figure 8B:
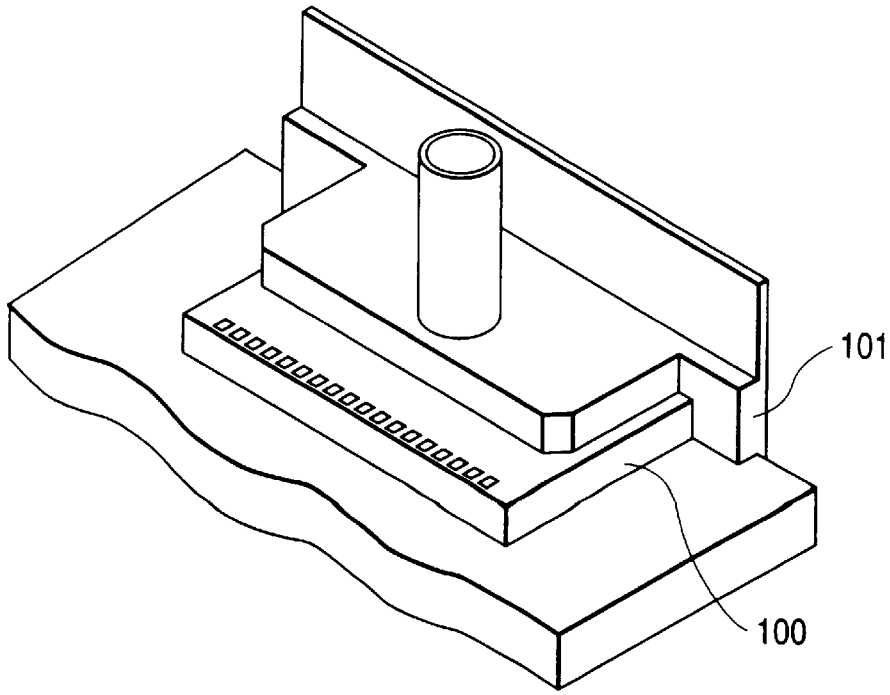
FIG. 8B PRIOR ART

Now, with reference to FIG. 5 to FIG. 7, the description will be made of a third embodiment in accordance with the present invention. FIGS. 5 to 7 illustrate a color liquid jet recording head in which a plurality of common liquid chambers are formed by providing a plurality of recessed portions on one and the same second substrate to make it possible for one liquid jet recording head to print in color by supplying ink of different colors to each of the common liquid chambers. FIG. 5 is a perspective view showing the color liquid jet recording head. FIG. 6 is a perspective view showing the second substrate that constitutes the color liquid jet recording head. FIG. 7 is an enlarged view showing the details of the principal part of the head.

The second substrate 51, which is joined to the first substrate 65 having a plurality of energy generating devices formed on it, comprises a plurality of ink flow paths (grooves) 52; a discharge opening plate 54 having a plurality of discharge openings 53 conductively connected with ink flow paths 52, respectively; and a plurality of recessed portions that become common liquid chambers, each partitioned by means of common liquid chamber separation walls 60 to temporarily retain ink to be supplied to each of the discharge openings 53. Further, on each of the common liquid chamber separation walls 60, the common liquid chamber partition grooves 57 are formed extendedly from the side where discharge openings are arranged to the side opposite to it in order to partition the common liquid chamber by filling sealing compound in the interior of the chamber. On each one end thereof, an injection opening 58 is arranged to inject sealing compound. Also, first dummy nozzles 61, which are arranged in parallel with a plurality of ink flow paths 52, are conductively connected with the common liquid chamber partition groove 57, respectively, and at the same time, these nozzles are extended up to the discharge opening plate 54. On both sides of each dummy nozzle 61, second dummy nozzles 62, 62, . . . are arranged extendedly up to the discharge opening plate 54. Then, each of the first dummy nozzles functions to receive and retain the sealing compound which flows in from each of the common liquid chamber partition grooves 57. A plurality of second dummy nozzles 62, 62, . . . serve to block the flow of the injected sealing compound into each of the ink flow paths 52, 52, . . . .

Here, the fine grains 71 whose main component is carbon, for example, are arranged to adhere to the surface of the second substrate 51 thus structured, which is joined to the first substrate 65, particularly the liquid chamber frames 56, liquid chamber separation walls 60, and the like on it, as in the first embodiment. Subsequently, the first substrate 65 and the second substrate 51 are joined in a state where the discharge energy generating devices on the first substrate 65 are positioned to face the ink flow paths 52, respectively. Then, using the sealing compound TSE399 (viscosity 2800 to 3100 cp) sealing is effectuated as shown in FIG. 2. At the same time, sealing compound is injected from the injection opening 58 to fill in the common liquid chamber grooves 57 to partition the liquid chamber accordingly.

For the color liquid jet recording head thus joined through the inclusion of fine grains 71, the same effect as described in conjunction with the first embodiment is demonstrated when the joining surface and circumference thereof are sealed as shown in FIG. 2. In this respect, the description will be made particularly of the common liquid partition grooves 57. When the color liquid jet recording head sealed through fine grains 71 is compared with the conventional color liquid jet recording head sealed without any inclusion of fine grains, it is found that whereas approximately 5% of the conventional color liquid jet recording heads have presented defective prints, the color liquid jet recording heads sealed through fine grains 71 have shown the reliable flow of sealing compound into the common liquid chamber partition grooves 57.

The reason that causes this difference will be described with reference to FIG. 7 which is an enlarged view of the principal part of the second substrate. For the liquid jet recording head of the present invention, which is sealed through the inclusion of fine grains 71, there is no possibility that the sealing compound injected into the common liquid chamber partition grooves 57 leaks out from the gap between the common liquid chamber separation walls 60 positioned on both sides of each of the common liquid chamber partition grooves 57 and the first substrate 65. Then, it runs on the interior of the common liquid chamber partition grooves 57 to flow into the first dummy nozzles 61. On the other hand, the conventional liquid jet recording head which is sealed without inclusion of any fine grains causes sealing compound to leak from the gap between the common liquid chamber separation walls 60 and the first substrate 65 in spite of the sufficient injection of the sealing compound, thus causing a phenomenon to take place that it does not flow into the first dummy nozzles. As a result, the liquid chamber is not completely partitioned for the conventional one, and causes ink colors to be mixed. This mixture of ink brings about defective prints.

Also, when there is no gap between the common liquid chamber separation walls 60 and the first substrate 65 so that no sealing compound leaks into liquid chambers, the sealing compound fills in not only the first dummy nozzles 61, but also, fills in the second dummy nozzles 62, and further, fills in the adjacent ink flow paths 52 of the conventional liquid jet recording head if the amount of injected sealing compound is too large. For the liquid jet recording head of the present invention, such flow of the sealing compound is blocked on the boundary where fine grains are provided. If any one of the flow paths is filled in as in the case of the conventional liquid jet recording head, non-discharge of ink takes place thereby to cause defective prints inevitably.

Also, in accordance with the third embodiment of the present invention, fine grains are included on the surface of the second substrate, which is joined to the first substrate, but it may be possible to enable fine grains to adhere to the surface of the dummy nozzles or the surface of the common liquid chamber partition grooves in consideration of the blocking effect of the fine grains with respect to the flow of sealing compound. In this way, the flow of the injected sealing compound is blocked at least at the location of the first dummy nozzles 61, thus avoiding its flow into the second dummy nozzles 62.

In accordance with the embodiments described above, the structure is arranged so that fine grains are provided before joining is effectuated. However, if no rigid control is required with respect to the location of fine grain adhesion as in the case of the gap (portion at 27 in FIG. 4) between the discharge opening plate and the first substrate, it is possible to fill in sealing compound after the first substrate and the second substrate have been joined together. As a method for filling in fine grains, there are such ones as giving ultrasonic vibration after injection of fine grains, as injecting pure water and drying it after fine grains have been filled in, or as injecting and drying the pure water into which granular substance has been mixed. Further, it may be possible to fill in the sealing compound with fine grains having been dispersed in it in advance.

Since the present invention is structured as described above, the selection range of the viscosity of usable sealing compound is widened for a liquid jet recording head, and no contamination is caused by the sealing compound. Also, there is no possibility that any contamination takes place even if the amount of sealing compound is larger for use, thus making it possible to lighten the controlling burden of sealing compound in the sealing step of manufacture. In this way, the sealing step can be executed easily in good production yield. Also, it becomes unnecessary to provide any receptacle to retain sealing compound as in the case of conventional art. Therefore, the simplification of formation process is possible, leading to the significant cost down of manufacture.

Further, for a color liquid jet recording head, it is possible to lighten the controlling burden of sealing compound likewise in the sealing step and the separation process of colors as well. Therefore, the color liquid jet recording heads can also be manufactured easily in good production yield at lower costs.

What is claimed is:

1. A method for manufacturing liquid jet recording heads comprising the following steps of:

preparing a first substrate having a plurality of discharge energy generating devices formed thereon;

preparing a second substrate having a discharge opening plate provided with a plurality of discharge openings for discharging ink, and recessed portions becoming ink flow paths conductively connected with said discharge openings, and a common liquid chamber for retaining ink for supply to each of said discharge openings, respectively;

causing fine grains, applied to a joint between said second substrate and first substrate, to adhere to said joint;

positioning said first substrate and second substrate so that the discharge energy generating devices of said first substrate face the recessed portions of said second substrate becoming ink flow paths, and forming said ink flow paths and common liquid chamber by joining said first substrate and second substrate together without an adhesive; and sealing the joint between said first substrate and second substrate by a sealing compound which seals a peripheral portion of a joint between said first and said second substrates, the fine grains preventing the sealing compound from entering the joint between the first and the second substrates.

2. A method for manufacturing liquid jet recording heads according to claim 1, wherein said fine grains contain as a main component thereof at least one element contained in a material of said second substrate.

3. A method for manufacturing liquid jet recording head according to claim 1, wherein said fine grains comprise a polymeric material having a hydroxyl group.

4. A method for manufacturing liquid jet recording heads according to claim 1, wherein said fine grains are formed from a material having carbon as a main component thereof.

5. A method for manufacturing liquid jet recording heads according to claim 1, wherein said second substrate is formed from a resin.

6. A method for manufacturing liquid jet recording heads according to claim 5, wherein said second substrate is formed by from a polysulfonic resin.

7. A method for manufacturing liquid jet recording head according to claim 6, further comprising the step of processing said second substrate by an excimer laser to provide said fine grains at said joint.

8. A method for manufacturing liquid jet recording heads according to claim 7, further comprising the following step of:

removing at least some of the fine grains adhering to a portion other than the joint between said first substrate and second substrate by selectively irradiating light from a YAG laser.

9. A method for manufacturing liquid jet recording heads according to claim 8, wherein light from said YAG laser is selectively irradiated onto the surface of said second substrate that is joined to the first substrate through a mask.

10. A method for manufacturing liquid jet recording heads according to claim 5, further comprising the step of processing said second substrate by a laser to provide said fine grains at said joint.

11. A method for manufacturing liquid jet recording heads according to claim 10, wherein said laser processing is performed by an excimer laser.

12. A method for manufacturing liquid jet recording heads according to claim 1, wherein said sealing compound is of a hygroscopic hardening type.

13. A method for manufacturing liquid jet recording heads according to claim 1, wherein said first substrate and second substrate are joined by compression of an elastic member.

14. A method for manufacturing liquid jet recording heads comprising the following steps of:

preparing a first substrate having a plurality of discharge energy generating devices formed thereon;

preparing a second substrate having a discharge opening plate provided with a plurality of discharge openings for discharging ink, and recessed portions becoming ink flow paths conductively connected with said discharge openings, and a plurality of common liquid chambers for retaining ink for supply to each of said discharge openings, respectively;

causing fine grains, applied at least to a region between said plurality of common liquid chambers at a joint of the second substrate to the first substrate, to adhere to said;

positioning said first substrate and second substrate so that the discharge energy generating devices of said first substrate face the recessed portions of said second substrate becoming ink flow paths, and forming said ink flow paths and common liquid chambers by joining said first substrate and second substrate together without an adhesive; and sealing the joint between said first substrate and second substrate by a sealing compound which seals a peripheral portion of a joint between said first and said second substrates, the fine grains preventing the sealing compound from entering the joint between the first and the second substrates.

15. A method for manufacturing liquid jet recording heads according to claim 14, wherein said fine grains contain as a main component thereof at least one element contained in a material of said second substrate.

16. A method for manufacturing liquid jet recording heads according to claim 14, wherein said fine grains comprise a polymeric material having a hydroxyl group.

17. A method for manufacturing liquid jet recording heads according to claim 14, wherein said fine grains are formed from a material having carbon as a main component thereof.

18. A method for manufacturing liquid jet recording heads according to claim 14, wherein said second substrate is formed from a resin.

19. A method for manufacturing liquid jet recording heads according to claim 18, wherein said second substrate is formed from a polysulfonic resin.

20. A method for manufacturing liquid jet recording heads according to claim 19, further comprising the step of processing said second substrate by an excimer laser to provide said fine grains at said joint.

21. A method for manufacturing liquid jet recording heads according to claim 20, further comprising the following step of:

removing at least some of the fine grains adhering to a portion other than the joint between said first substrate and second substrate by selectively irradiating light from a YAG laser.

22. A method for manufacturing liquid jet recording heads according to claim 21, wherein light from said YAG laser is selectively irradiated onto the surface of said second substrate that is joined to the first substrate through a mask.

23. A method for manufacturing liquid jet recording heads according to claim 18, further comprising the step of processing said second substrate by a laser to provide said fine grains at said joint.

24. A method for manufacturing liquid jet recording heads according to claim 23, wherein said laser processing is performed by an excimer laser.

25. A method for manufacturing liquid jet recording heads according to claim 14, wherein said sealing compound is of a hygroscopic hardening type.

26. A method for manufacturing liquid jet recording heads according to claim 14, wherein said first substrate and second substrate are joined by compression of an elastic member.

27. A method for manufacturing liquid jet recording heads according to claim 14, wherein said second substrate is provided with a plurality of common liquid chamber partition grooves between respective common liquid chambers, and a seal between said common liquid chambers is effectuated by injecting said sealing compound into said common liquid partition grooves.

28. A method for manufacturing liquid jet recording heads according to claim 27, wherein said common liquid chamber partition grooves extend to the discharge opening plate portion through an ink flow path portion, and a plurality of dummy nozzles not used for discharging ink are provided in said second substrate for the ink flow path portions adjacent to said common liquid chamber partition grooves.

29. A method for manufacturing liquid jet recording heads according to claim 14, wherein said fine grains adhere at the joint between said discharge opening plate of said second substrate and said first substrate, and at the same time, the joint between said discharge opening plate and said first substrate is sealed by the sealing compound.

* * * * *

UNITED STATES PATENT AND TRADEMARK OFFICE

CERTIFICATE OF CORRECTION

PATENT NO. : 6,220,688 B1
DATED : April 24, 2001
INVENTOR(S) : Shin Ishimatsu et al.

It is certified that error appears in the above-identified patent and that said Letters Patent is hereby corrected as shown below:

Column 1,
Line 55, "s" should read -- sides of --;
Line 56, "sealing" should read -- the sealing --; and
Line 57, "receptacles" should read -- receptacles, it is still --.

Column 2,
Line 16, "mid way" should read -- midway --;
Line 22, "devise" should read -- device --; and
Line 54, "by" should read -- by the --.

Column 3,
Line 8, "by" should read -- by the --;
Line 23, "ink" should read -- inks --;
Line 25, "Between" should read -- Joints between --;
Line 48, "by" should read -- by the --;
Line 61, "seal by" should read -- sealed by the --; and
Line 63, "through" should read -- through the --.

Column 4,
Lines 19 and 29, "by" should read -- by the --;
Line 31,"through" should read -- through the --;
Line 51, "that" should read -- that a --;
Line 54, "of" should read of the --; and
Line 63, "as" should read -- as a --.

Column 5,
Line 47, "such" should read -- such a --.

Column 7,
Line 2, "go" should be deleted;
Line 7, "such" should read -- such a --;
Line 12, "is" should read -- are --; and
Line 64, "of" should read -- of the --.

Column 8,
Line 8, "as" should read -- as a --; and
Line 26, "of" should read -- of the --.

UNITED STATES PATENT AND TRADEMARK OFFICE

CERTIFICATE OF CORRECTION

PATENT NO. : 6,220,688 B1
DATED : April 24, 2001
INVENTOR(S) : Shin Ishimatsu et al.

It is certified that error appears in the above-identified patent and that said Letters Patent is hereby corrected as shown below:

Column 9,
Line 30, "of" should read -- of the --; and
Line 59, "also," should read -- also --.

Column 11,
Lines 10 and 22, "head" should read -- heads --; and
Line 24, "said;" should read -- said region; --

Signed and Sealed this

Twenty-sixth Day of February, 2002

*Attest:*

*Attesting Officer*

JAMES E. ROGAN
*Director of the United States Patent and Trademark Office*